United States Patent [19]

Keller

[11] Patent Number: 4,458,842

[45] Date of Patent: Jul. 10, 1984

[54] RESONANT CHAMBER ATOMIZER FOR LIQUIDS

[75] Inventor: Jakob Keller, Killwangen, Switzerland

[73] Assignee: BBC Brown, Boveri & Company, Limited, Baden, Switzerland

[21] Appl. No.: 314,484

[22] Filed: Oct. 23, 1981

[30] Foreign Application Priority Data

Oct. 29, 1980 [CH] Switzerland ..... 8032/80

[51] Int. Cl.[3] ..... B05B 3/14

[52] U.S. Cl. ..... 239/102; 239/590.5

[58] Field of Search ..... 239/101, 102, 590.3, 239/590.5, DIG. 20

[56] References Cited

U.S. PATENT DOCUMENTS

| | | | |
|---|---|---|---|
| 3,226,029 | 12/1965 | Goodman et al. | 239/102 |
| 3,326,467 | 6/1967 | Fortman | 239/102 |
| 3,334,657 | 8/1967 | Smith et al. | 239/102 |
| 3,779,460 | 12/1973 | Monro | 239/102 |
| 3,911,858 | 10/1975 | Goodwin | 239/102 |
| 4,205,786 | 6/1980 | Babich et al. | 239/102 |
| 4,240,293 | 12/1980 | Hughes | 239/590.5 |
| 4,241,877 | 12/1980 | Hughes | 239/590.3 |

FOREIGN PATENT DOCUMENTS

| | | | |
|---|---|---|---|
| 945692 | 1/1964 | United Kingdom | 239/102 |
| 775514 | 11/1980 | U.S.S.R. | 239/102 |

*Primary Examiner*—John J. Love
*Assistant Examiner*—Michael J. Forman
*Attorney, Agent, or Firm*—Burns, Doane, Swecker & Mathis

[57] ABSTRACT

The present invention relates to a resonant chamber atomizer for liquids. The atomizer possesses supply lines for the atomizing gas and the liquid to be atomized as well as an outflow chamber for the mixture of gas and atomized liquid. Between the outflow cross-section of the supply line for the gas and the cross-section of the entry of the outflow channel there is a resonant chamber. The chamber is bounded by plane surfaces and has a flat, preferably prismatic, form. The main dimension of the chamber runs transverse to the direction of flow in the atomizer.

6 Claims, 7 Drawing Figures

RESONANT CHAMBER ATOMIZER FOR LIQUIDS

BACKGROUND AND SUMMARY OF THE PRESENT INVENTION

The present invention relates generally to a resonant chamber atomizer for liquids. More particularly the present invention relates to a novel resonant chamber atomizer for oil burners.

When liquid-atomizers for low-power oil-fired systems are used with the known mixing devices it is generally not possible, without elaborate equipment and corresponding high costs, to achieve the maximum degree of combustion with a stoichiometric or quasi-stoichiometric fuel/air ratio. Consequently, it is not possible to utilize the fuel to the extent which is desirable in view of present-day fuel prices and, even more, in view of the fuel prices to be expected in the future.

In the case of liquid fuels, a prerequisite for residue-free combustion is very fine atomization and intimate homogeneous mixing with the quantity of air necessary for combustion. If the fuel is not atomized sufficiently finely, a greater quantity of air is required for a moderately satisfactory degree of combustion. This excess air results in an increase in the thermal energy contained in the exhaust gases.

By achieving a finer atomization and employing a corresponding lower quantity of combustion air, the thermal energy contained in the exhaust gases is reduced, thus resulting in better utilization of the combustion heat.

Such a fine atomization is not possible with the conventional small burners for domestic heating systems. Accordingly, a series of disadvantages related to economy and operation results. Thus, it is not possible to operate the burner with a fuel supply which is as low as desired, that is, with a partial load. Such a low fuel supply may cause the flue to become sooted due to the incomplete combustion and consequently there may be the danger of a fire in the flue. If the large excess of air necessary for complete combustion is not supplied, the combustion temperature and, consequently, also the exhaust-gas temperature is not high enough to prevent the $SO_2$ arising during the incomplete combustion from being at a temperature below the dew point. Consequently, the temperature is not high enough to prevent corrosion at the exit of the boiler caused by the condensed $SO_2$.

It is an object of the resonant chamber atomizer according to the present invention to provide an atomizer which is suitable especially for oil burners of relatively low power. The atomizer according to the present invention offers, with a simpler design and less expensive manufacture, an improved fuel utilization in comparison with the present state of the art.

These and other objects of the present invention are achieved by utilizing the fact that gas vibrations with pressure waves of high amplitudes, which pressure waves exert a strong atomizing effect on liquid particles contained in the gas, occur in resonant cavities or chambers.

BRIEF DESCRIPTION OF THE DRAWINGS

The invention will be described in more detail below with reference to preferred embodiments illustrated in the drawings wherein like members bear like reference numerals and wherein.

DETAILED DESCRIPTION OF THE PREFERRED EMBODIMENTS

Figure 1:
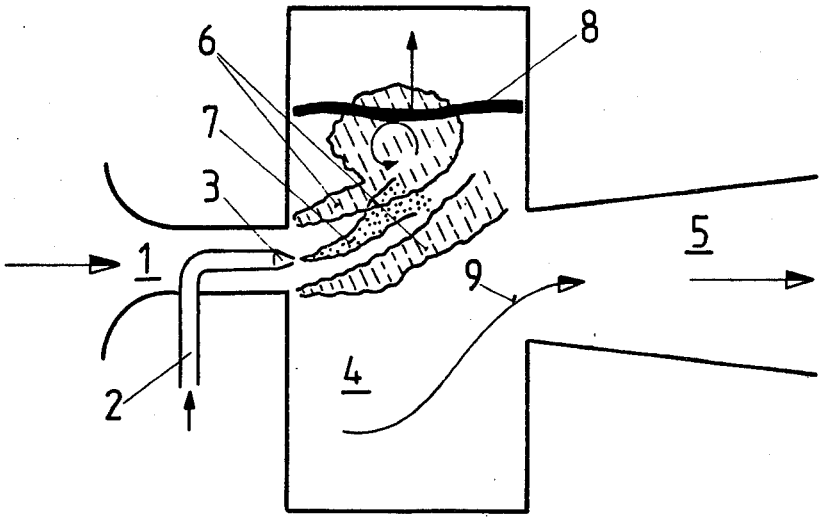
FIGS. 1 to 3 are schematic views of three embodiments of an atomizer according to the present invention, with different arrangements of the air and fuel nozzles and of the mixing chambers.

The general principles of the present invention will first be described with reference to the simplest arrangement, shown in FIG. 1, of an air nozzle, fuel nozzle and mixing chamber which is, in terms of its function, a resonant chamber.

A fuel delivery line 2 having a fuel nozzle 3 opening into a resonant chamber 4 is located along an axis of an air channel 1. The resonant chamber 4 is a flat cuboid space having a height at right-angles to the drawing plane equal to the mouth diameter of the air channel 1 at the entry into the resonant chamber 4. The fuel/air mixture atomized in the resonant chamber 4 passes through a burner nozzle 5 arranged as a diffuser into a combustion chamber (not shown) where the mixture is ignited.

Both the air nozzle 1 and the burner nozzle 5 are of rectangular cross-section with the nozzle width at right-angles to the drawing plane being equal to the width of the resonant chamber 4 at the transition into the resonant chamber. It is also possible for the cross-section of these nozzles to merge from a rectangle at the narrowest point into an elliptical, circular or other cross-section at their widest point.

In the mixing chamber, cavity vibrations with high pressure amplitudes arise since the mixing chamber is arranged as a resonant chamber 4. As mentioned in the introduction, these vibrations bring about especially good atomization of the fuel passing through the nozzle 3 (together with the air) into the resonant chamber.

When the air flows out of the air channel 1 into the resonant chamber 4, the air jet (the boundary region 6 being illustrated in FIG. 1) is deflected, together with the fuel jet 7 sucked out of the fuel nozzle 3, into one half of the resonant chamber 4 by a strong sonic wave (the wave front of the sonic wave is designated by 8). After the wave has been reflected on the upper wall of the chamber 4, its front, on which, in the meantime, a wave front generated as a result of the impact of the jet on a downstream wall part has been superimposed, strikes the fuel jet 7 with considerable violence. The fuel jet 7 which is already broken into fine droplets is atomized into an extremely fine mist by the wave front. The repeated return of the wave front causes the fine mist to be sucked along by the wake of the wave front and, as indicated by the arrow 9, be conveyed through the burner nozzle 5 into the combustion chamber. The fine fuel mist is burned completely in the combustion chamber with a substantially reduced quantity of air than in the case of conventional burners.

At equilibrium, the primary wave in the chamber is fed continuously by secondary waves which are generated as a result of the impact of the jet on the downstream wall parts of the resonant chamber. Thus, the primary wave runs back and forth in the resonant chamber, with an almost constant amplitude transverse to the axis of the burner nozzle. The back and forth motion of the wave breaks up the inflowing fuel jet into the extremely fine mist which is intimately mixed with air. After each time the wave front has passed the inflow cross-section of the burner nozzle, the mist is sucked into the burner nozzle.

Figure 2:
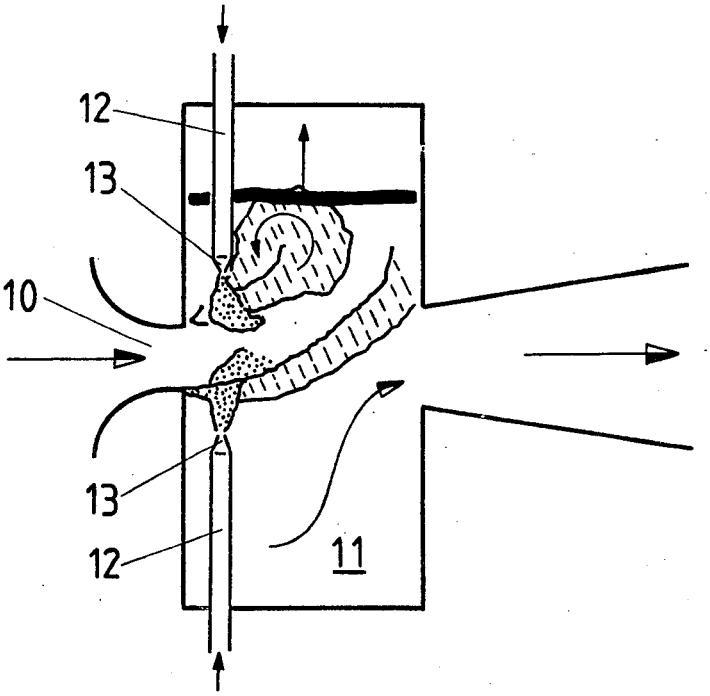

The embodiment illustrated schematically in FIG. 2 differs from the embodiment of FIG. 1 in that the fuel is supplied via two fuel delivery lines 12 which are arranged in the resonant chamber 11 transverse to the axis of an air channel 10. Nozzles 13 at the end of each of the fuel delivery lines 12 terminate in the boundary region of the airstream entering the resonant chamber.

In another alternative embodiment (FIG. 3), a resonant chamber 14 includes two halves 15 with the axes of the two halves 15 of the chamber 14 being inclined to the common axis of an air channel 16 and a burner nozzle 17. In other words, an axial cross-section of the chamber is comprised of two trapezoids having nonparallel sides of unequal lengths. One side of each trapezoid is perpendicular to the parallel sides and the other sides of the two trapezoids coincide. In this arrangement, the secondary waves arise at the end walls of the resonant chamber 14. Under certain circumstances, this arrangement leads to a more complete superimposing of the secondary waves on the primary wave and produces a more complete atomization of the fuel.

Figure 4:
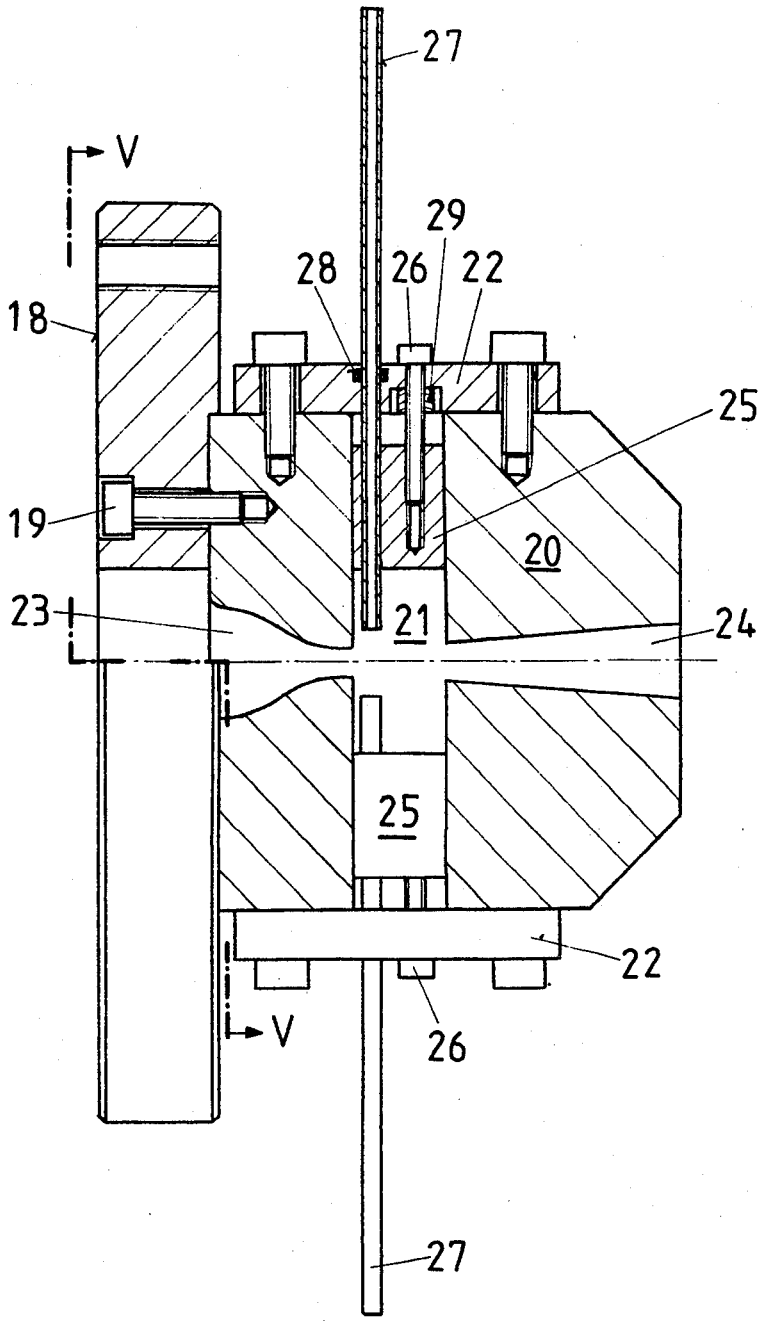
FIGS. 4 and 5 are partial cross-sectional views of a preferred embodiment of the atomizer in a burner in a plan view and a side view, respectively.
Figure 5:
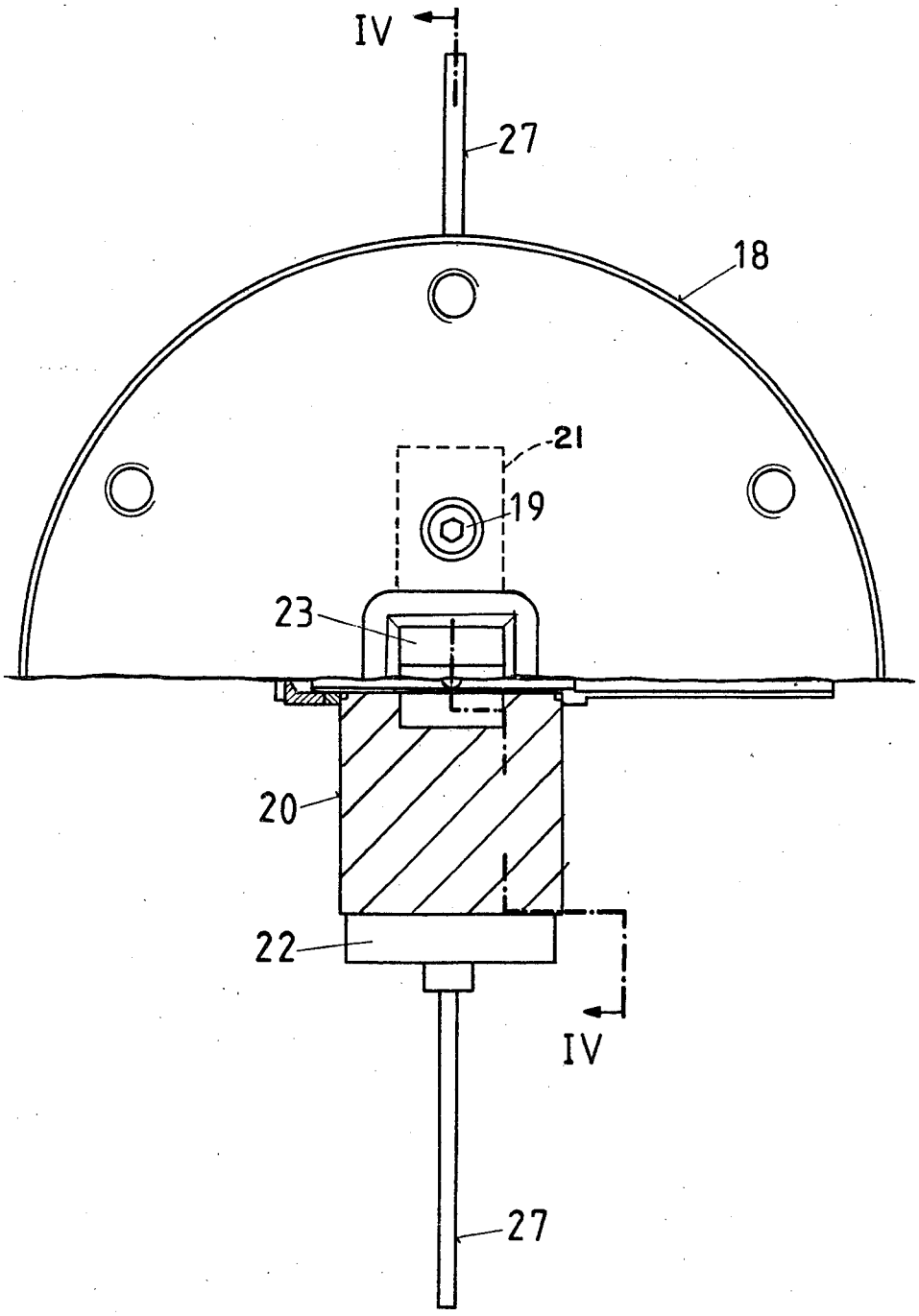

With reference to FIGS. 4 and 5, and with an arrangement of an atomizer according to the schematic drawing of FIG. 2, a burner housing 20 is screwed to a housing of a heating boiler by a mounting flange 18. The burner housing 20 includes a resonant chamber 21 sealed off from the outside by covers 22. The burner housing 20 is fastened to the flange 18 by hexagon socket screws 19. The cross-section of the resonant chamber 21 parallel to the common axis of an air channel 23 and a burner nozzle 24 is rectangular. The height of the resonant chamber can be adjusted by two sliding pieces 25, each actuated with one adjusting screw 26. In this way, the optimum atomizing effect can be obtained with the pressure drop provided between the air-channel inflow and the burner-nozzle outflow. The two fuel delivery lines 27, the free ends of which form nozzles, project through bores in both the covers 22 and the sliding pieces 25 into the resonant chamber 21. The delivery lines 27 are sealed off from the outside by O-rings 28. Sealing sleeves 29 are provided for sealing off the adjusting screws 26.

Figure 6:
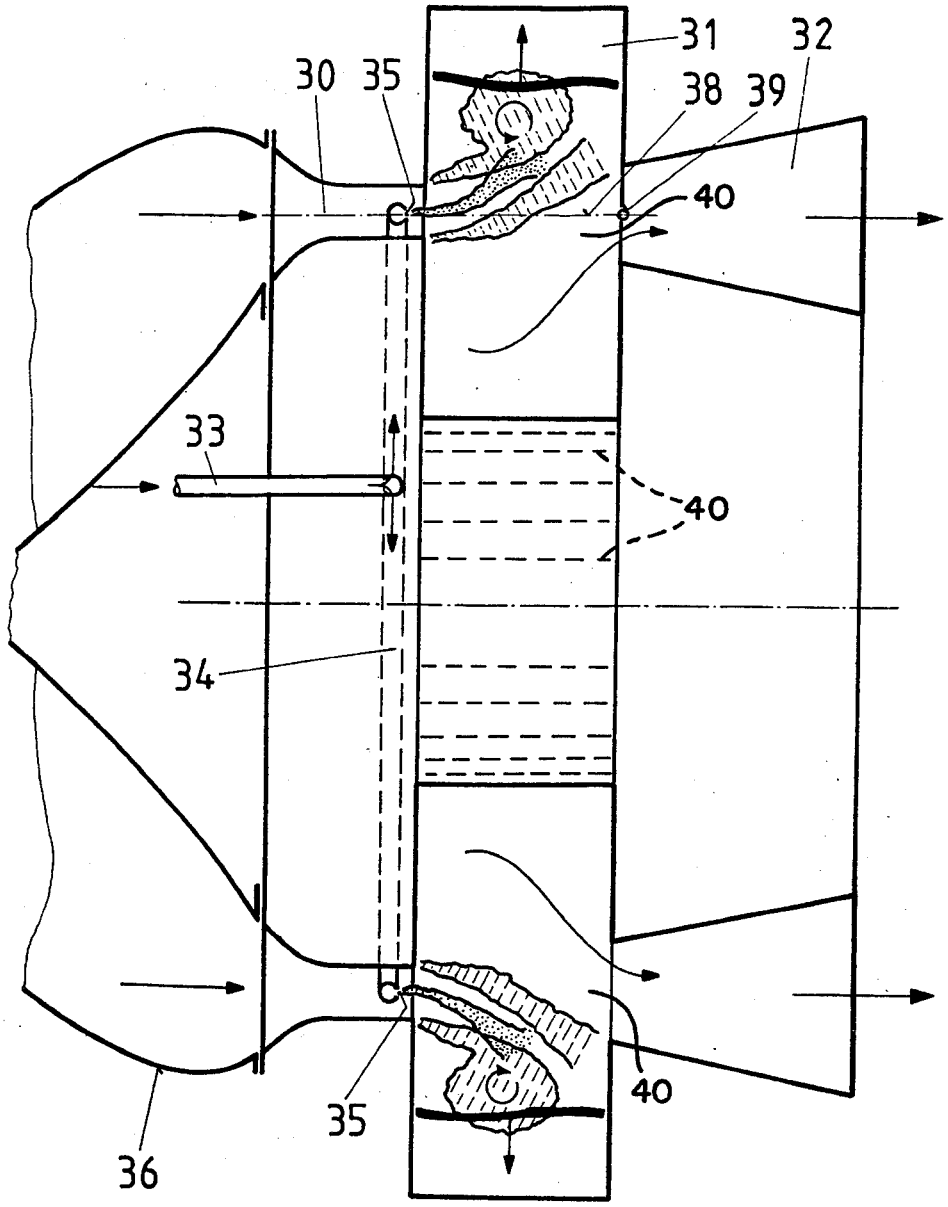
FIG. 6 shows an embodiment of the atomizer in the form of a ring burner.

With reference to FIG. 6, a ring burner operates on the same principle as the atomizers described above with an air channel 30, a resonant chamber 31 and a burner nozzle 22 each being annular bodies of revolution. Fuel is supplied via a fuel delivery line 33 into an annular fuel line 34 which has nozzles 35 distributed at equal intervals over the perimeter of the fuel line 34. Air conveyed by a blower (not shown) passes through a rotationally symmetrical intake-mouth 36 into the annular air channel 30.

A region of the annular resonant chamber 31 in which the mechanism of atomization takes place as described above is assigned to each of the nozzles 35. These regions do not need to be separated physically from one another, but the cavity vibrations in the regions may influence one another to a certain extent. However, the atomizing effect is not substantially impaired as a result of the interaction between the regions.

It is, of course, also possible to partition off these regions from one another, by radially extending intermediate walls 40 so that the cavity vibrations in one region do not influence the vibrations in adjacent regions. The combustable mixtures emerging from the individual regions separated from one another combine into a continuous annular jet in the annular burner nozzle 32.

Figure 7:
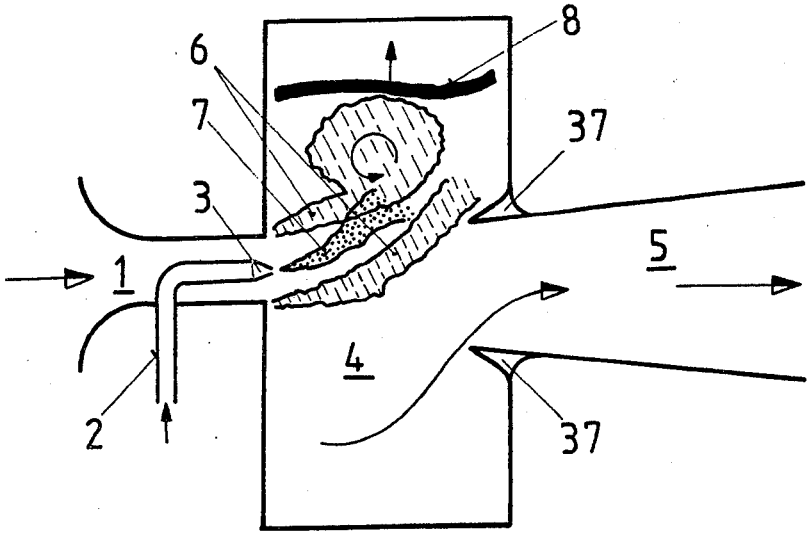
FIG. 7 is a view of an alternative form of the embodiment of the atomizer according to FIG. 1.

With reference to FIG. 7, interference-lips 37 are provided at the top and bottom of the entrance to the burner nozzle 5. The interference-lips 37 are adapted to reinforce the secondary waves, especially in the case of weak blower pressures, whereby the amplitudes of the cavity vibrations and, consequently, the atomizing effect are reinforced.

Figure 3:
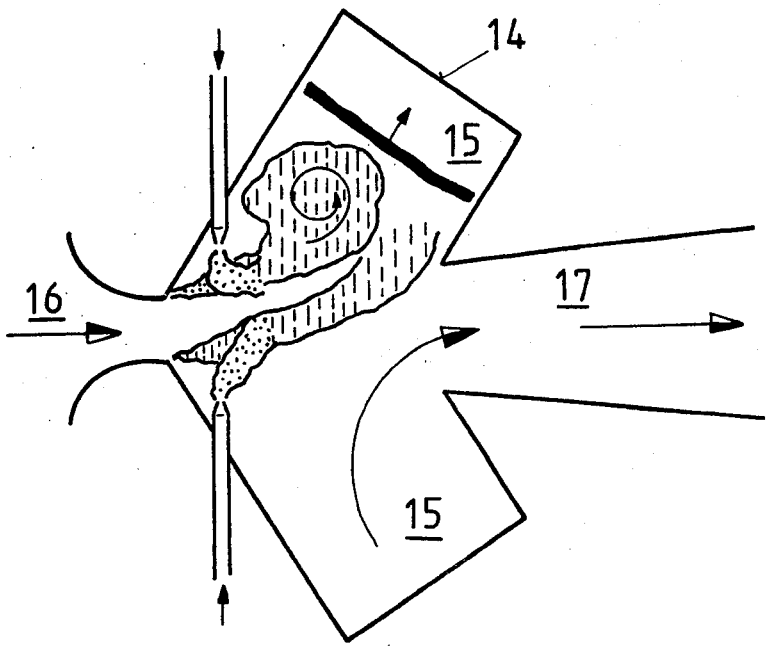

With references to FIG. 3, wherein the halves 15 of the resonant chamber 14 are inclined with respect to the jet axis, the same effect, i.e., the reinforcement of the secondary waves, is produced by the sharp edges of the acute-angled cross-section. The sharp edges are formed by the upper and lower walls of the burner nozzle 17 and the two front inclined walls of the resonant chamber 14.

In the annular burner according to FIG. 6, the resonant chamber may be provided with an axial section corresponding to the arrangement according to FIG. 3. Generally, the axial section then has the form of a polygon which is bounded by essentially straight lines. The axis of symmetry 38 of the polygon (as shown in the top half of FIG. 6) is determined by the center point of a single fuel nozzle 35 and the center point 39 of the height of the annular burner nozzle 32, i.e., the outflow channel at its cross-section of entry.

In an annular combustion chamber similar to the arrangement according to FIG. 6 the fuel may be fed into the region of the air jet flowing out of the annular air channel 30 by an arrangement other than the annular fuel line 34. The fuel may be fed into the air jet by a plurality of radial lines extending into the resonant chamber from the outside or from the inside.

The exemplary embodiments described here have shown the application of the atomization principle according to the invention to burner devices. However, the present invention is in no way restricted to these applications alone, but can be applied to all atomization equipment in which it is important to obtain an especially fine mist, for example, in surface-coating technology.

One advantage of the resonant chamber atomizer according to the present invention in comparison with conventional ultrasonic atomizers is that it operates efficiently even at a low pressure. Consequently, the atomizer can be operated by a blower of comparatively low power and generate vibration amplitudes which are higher than in conventional mechanical ultrasonic atomizers. The amplitudes generated by the present invention are comparable to the amplitudes obtained by conventional resonant chamber atomizers operating at a high pressure (1 to 2 atm. gauge).

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations of changes may be made by others without departing from the spirit of the present invention. Accordingly, it is expressly intended that all such variations and changes which fall within the spirit and scope of the present invention as defined in claims be embraced thereby.

What is claimed is:

1. A resonant chamber atomizer for liquids, comprising a supply line for feeding a gas serving for atomization to a mixing chamber, a supply line for feeding a liquid to the mixing chamber for the gas and the liquid, a nozzle at an end of the supply line for the liquid within the chamber, an outflow channel for the atomized mixture which channel leads outwards from the mixing chamber, an outflow cross-section of the supply line for the gas and an inflow cross-section of the outflow channel having a common geometrical axis, the mixing chamber being a resonant chamber of a relatively flat parallelepipedic form, the width of the outflow cross-section of the supply line being equal to the smallest dimension of the parallelepipedic form, said smallest dimension lying perpendicular to the fluid flow in the atomizer, the resonant chamber extending symmetrically on both sides of the common geometrical axis.

2. The resonant chamber atomizer as in claim 1, wherein the resonant chamber is a relatively flat rectangular prism.

3. The resonant chamber atomizer as in claim 2, further comprising interference-lips at two opposite edges of the inflow cross-section of the outflow channel which is a burner nozzle, the interference-lips being formed by penetration of a portion of the burner nozzle into the chamber and a wall of the resonant chamber.

4. The resonant chamber atomizer as in claim 1, wherein the resonant chamber is a parallelepiped, the cross-section of the chamber being comprised of two trapezoids having parallel sides of unequal lengths, one of the other sides of each trapizoid being arranged at right angles to the parallel sides and the remaining sides of the two trapezoids coinciding with one another.

5. A resonant chamber atomizer for oil burners, comprising an annular supply line for feeding combustion air serving for atomization and an annular supply line for feeding oil to a mixing chamber for the air and the oil, the annular supply line for the oil arranged within the annular air supply line, a plurality of fuel nozzles distributed over an inner perimeter of the oil supply line and directed toward the mixing chamber, an annular burner nozzle for the atomized combustion mixture which burner nozzle leads outwards from the mixing chamber, a center diameter of the annular air supply line and the annular burner nozzle being equal and coaxial, the mixing chamber being designed as an annular resonant chamber, the annular resonant chamber being divided into a plurality of relatively flat, mutually separate resonant chambers, one of the nozzles being directed toward a corresponding one of the separate resonant chambers, an axial section of each of the separate resonant chambers being a symmetrical polygon, the axis of symmetry of the polygons being defined by the center diameter.

6. The resonant chamber atomizer according to claim 5, wherein the polygon of the axial section of the resonant chamber is a rectangle.

* * * * *